United States Patent [19]

Reimpell et al.

[11] 4,394,765

[45] Jul. 19, 1983

[54] ELECTRO-SLAG REMELTING FURNACE FOR CONSUMABLE ELECTRODES AND HAVING AN ELECTRODE DRIVE

[75] Inventors: Uwe Reimpell, Hanau; Helmut Gröf, Bruchköbel; Franz-Georg Knell; Anton Wamser, both of Hanau, all of Fed. Rep. of Germany

[73] Assignee: Leybold-Heraeus GmbH, Cologne, Fed. Rep. of Germany

[21] Appl. No.: 324,995

[22] Filed: Nov. 25, 1981

[30] Foreign Application Priority Data

Dec. 15, 1980 [DE] Fed. Rep. of Germany ..... 3047214

[51] Int. Cl.[3] ..... H05B 7/109

[52] U.S. Cl. ..... 373/52; 373/53; 373/105

[58] Field of Search ..... 373/52, 105, 51, 106, 373/53, 94, 69, 98, 67, 99, 100

[56] References Cited

U.S. PATENT DOCUMENTS

| | | | |
|---|---|---|---|
| 3,689,680 | 9/1972 | Reimpel et al. | 373/51 |
| 3,744,989 | 7/1973 | Doenecke | 373/51 |
| 4,280,550 | 7/1981 | Roberts | 373/52 X |

FOREIGN PATENT DOCUMENTS

| | | | |
|---|---|---|---|
| 845781 | 6/1970 | Canada | 373/53 |

*Primary Examiner*—Roy N. Envall, Jr.
*Attorney, Agent, or Firm*—Max Fogiel

[57] ABSTRACT

An electro-slag remelting furnace having consumable electrodes and a mold for receiving a melt formed from the electrode material; at least one drive motor and at least one spindle and an associated stationary spindle nut for vertical movement of the electrode; at least one guide column, which is provided for vertically guiding the consumable electrodes and which extends parallel with the spindle and relative to which the spindle is rotatable mounted at its two ends; and at least one clamping device for the consumable electrodes.

10 Claims, 6 Drawing Figures

FIG. 5
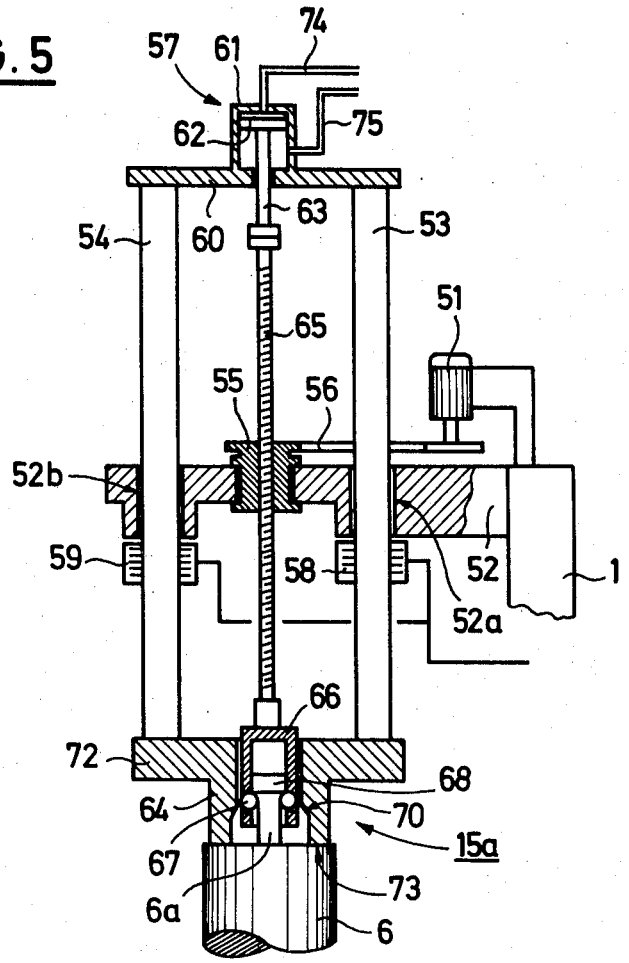
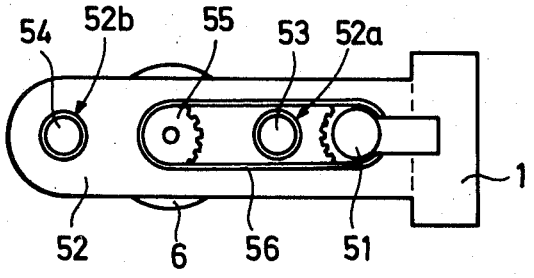
FIG. 6

ELECTRO-SLAG REMELTING FURNACE FOR CONSUMABLE ELECTRODES AND HAVING AN ELECTRODE DRIVE

BACKGROUND OF THE INVENTION

The invention concerns an electro-slag remelting furnace for consumable electrodes and comprising a mold for receiving a melt formed from the electrode material; at least one drive motor and at least one spindle and an associated spindle nut for vertical movement of the electrode; at least one guide column, which is provided for vertically guiding the consumable electrodes and which extends parallel with the spindle and relative to which the spindle is rotatably mounted at its two ends; and at least one clamping device for the consumable electrodes.

Such an electro-slag remelting furnace can be equipped with a mold of fixed location, known as a static mold, or with a mold that can be moved upwards and downwards and known as a sliding mold. With this equipment, either an electrode of suitable length can be fused to form a thicker block, or by means of two separate electrode-feed devices, one after the other, or to some extent simultaneously, to provide a block. The expression "change-over technique" has been introduced to designate the last-mentioned remelting process. Of particular importance in this process are the electrode-feed devices, since the remelting process is mainly determined and influenced by the rate of feed. It is necessary to be able to control the electrode feed with great accuracy and, particularly by the more extensive use of process computers, to be able to determine all the melting parameters, including the electrode feed rate, so that these parameters can be made available in advance in the form of a program for controlling the melting process.

U.S. Pat. No. 3,684,001 discloses a feed installation for electro-slag melting furnaces and wherein the electrode is moved downwards and upwards by means of hydraulic cylinders of fixed location. Such a form of construction offers, on the one hand, the advantage that the component of the feed installation that is located at the highest point is lowered as consumption of the electrode proceeds since when a plurality of hydraulic cylinders are arranged laterally of the electrode, the upwardly projecting thrust rods which are interconnected by a yoke from which the electrode is suspended, move downwards during the feed. This is of particular importance since, in the case of very long electrodes, very long feed paths must be present so that when melting begins, the height of the equipment is very great since at this moment the feed equipment is in its highest position. This necessitates particularly high workshop bays, since the crane installations required for charging the furnace must be provided at a high level if adequate unoccupied space above the furnace does not result from the following lowering movement of the feed installation. On the other hand, feed installations comprising hydraulic or compressed-air cylinders suffer from the disadvantage that unrequired lowering of the electrode takes place if the pipework develops leaks or becomes broken. Furthermore, in the case of such pressure-medium drives, the control of the very slow feed rate during melting off is possible only at considerable expense if a completely continuous and uniform electrode feed is to be obtained.

Electro-mechanical drives in conjunction with screw-threaded spindles, particularly ball-mounted spindles, are especially advantageous for providing a high-precision electrode feed. Because of the low friction involved in spindle drives of this kind, no appreciable locking effect ("slip-stick effect") occurs, and by the use of a multi-motor drive it is possible to achieve very high accuracy in the regulation of the feed in greatly varying speed ranges. The known electro-mechanical drives comprising screw-threaded spindles suffer from other disadvantages, however.

U.S. Pat. Nos. 2,857,445 and 3,057,935 disclose remelting furnaces which, with the exception of the use of slag, correspond to the initially described type of furnace. In both cases the screw-threaded spindles of fixed location are arranged laterally of the electrode and are mounted at their ends in a portal-like frame. This frame determines the height of the entire furnace, which height cannot be altered. The spindle nuts are mounted in a transverse member which is movable in the vertical direction on two vertical guide columns, likewise of fixed location. The use of more than one spindle and spindle nut renders the furnace construction expensive; furthermore, the furnace is difficult of access from above.

U.S. Pat. Nos. 3,379,238 and 3,393,264 disclose similar furnace constructions wherein the guide columns are of fixed location and form a portal-like frame. In these two cases, a central screw-threaded spindle of fixed location is provided, which is located within a tube which also forms the electrode-retaining bar, which is movable on the guide columns by means of sliding guides. The thus imposed unalterable height of the construction is substantially greater than in the case of the above-described furnaces, since because of the telescopic interengagement of the spindle and the electro-retaining bar, the height of the portal-like frame must be such that it is equal to at least twice the length of the spindle, i.e. twice the maximum length of the electrode. The length of the spindle in turn determines the maximum stroke of the electrode-clamping device. The screw-threaded spindle together with the drive units must therefore be located at so high a level that, for the maximum length of electrode, the electrode-retaining bar together with the spindle nut can be brought into the highest position. This maximum height then determines the height of the entire installation.

Furthermore, the known furnaces cannot be used for, and indeed are not designed for, the above-described "change-over technique". Particularly in the case of electro-slag remelting furnaces involving the use of change-over technique and wherein the electrodes are remelted one after the other to form a large block, heights of construction result for which the existing workshop bays and levels of crane track are inadequate, so that considerable expenditure is necessary for increasing the size of the bays or for providing pits for the foundations.

The known solution involving the telescopic engagement of the screw-threaded spindle in the electrode-retaining bar is accompanied by the further disadvantage that additional guides must be provided for the spindle nut and the electrode-retaining bar in order to take up the torque transmitted to the electrode-retaining bar and to prevent deflection of the electrode bar and therefore the electrode, as well as to avoid bending of the spindle.

U.S. Pat. No. 3,739,066 discloses an electro-slag remelting furnace comprising a plurality of guide columns which can be raised and lowered by means of screw-threaded spindles of fixed location. The "change-over technique" can also be carried out with this known installation, since the guide columns together with the electrode-clamping device secured to them can be lowered and swiveled independently of each other. In the case of this electro-slag remelting furnace, the free space above the mold is increased by lowering the guide columns. However, though having proved successful in large installations, this form of construction, when used in connection with smaller furnaces, suffers from the disadvantage that the length of the guide columns corresponds to the height of the furnace, so that an expensive furnace construction results. Furthermore, the spindles are of fixed location, whereas the spindle nuts secured to the guide columns are vertically displaceable. This results in compressive loading of the spindles which consequently must be of large cross-section. Because of their length, the guide columns must of necessity extend along the periphery of the mold, so that a gallows-like construction results which leads to large bending moments in the guide columns. In particular, however, because of the exposed current loops and the associated high inductive losses, the known construction does not permit the use of current-supply means operating on mains frequency, so that the known installation has to operate on alternating currents of extremely low frequency, for example 1 to 5 Hz, and this requires the use of expensive inverters.

SUMMARY OF THE INVENTION

The object of the invention is, therefore, to provide an electro-slag remelting furnace of the initially described kind which corresponds to U.S. Pat. No. 3,379,238, wherein the drive is achieved by means of at least one screw-threaded spindle, the vertical extent of the furnace is reduced by lowering the electrode clamping drive, the length of the guide column is not greater or considerably greater than the length of the spindle, and the guide column is not subjected to bending load by the weight of the electrodes.

According to the invention and in the case of the initially described electro-slag remelting furnace, this object is achieved in that the spindle nut is of fixed location, the spindle nut is mounted for vertical displacement in the spindle nut, the spindle is connected by its lower end to the clamping device and the guide column together with the spindle is displaceable in a vertical guide.

A considerably simpler construction of the entire electro-slag remelting furnace is associated with the arrangement in accordance with the invention. Because of the fixed location of the spindle nut and the vertically displaceable mounting of the spindle in the nut, the spindle and the associated drive motors can be lowered into a position which, to the extent of approximately the length of the spindle, lies below the highest position thereof in which an electrode of maximum length can be inserted, i.e. the component located at the highest point can be lowered to an extent equalling the maximum length of the electrode, so that considerable free space is created above the furnace for the purpose of loading, movement of the crane bridges, etc. Connection of the lower end of the spindle with the clamping device results in no bending moments or other transverse forces at all that effect the spindle. Only that portion of the spindle located below the spindle nut is subjected to mechanical load and this is, in fact, exclusively a tensile load, whereas the portion of the spindle located above the spindle nut is subjected only to torque. Since the guide column and the spindle are jointly displaceable, no "portal" of whatever kind is present above the mold at a constant level, and the spindle is still guided relatively to the spindle nut in an efficient manner. In this arrangement, no bending moments caused by the weight of the electrode act on the guide column at all, and it has to be borne in mind that the electrode may be many tons in weight. The guide for the guide column is consequently likewise substantially free from forces that could have the effect of tilting the guide column in the guide.

With the electro-slag remelting furnace in accordance with the invention, the guide column together with the spindle and the spindle drive as well as the electrode suspended from the spindle move downwardly as more of the electrode is consumed, until the upper end of the spindle reaches the spindle nut. This means that the effective height of the entire installation is determined by the lowest position of the spindle or the lowest consumption position. The spindle moves briefly into its highest position only for the purpose of enabling the electrode to be swung in and inserted into the crucible. The height of the furnace is continuously reduced during the entire remelting process, so that free space is available above the installation for operating a crane bridge and for other conveying operations.

Furthermore, with the furnace construction in accordance with the invention, it is possible to obtain a double-wound current-carrying system in a simple manner, so that the furnace can be operated on mains frequency without the need for taking into account intolerable inductive losses.

A drive motor can be associated either with the spindle or the spindle nut, and in the latter case the nut must, of course, be mounted so as to be rotatable. For design reasons, however, it is preferred to associate the drive motor with the spindle.

However, a special advantage lies in a combination of the two possible drive arrangements, i.e. in associating the spindle as well as the nut with a separate drive motor for each. A combined drive of the kind offers the advantage that the drive units can be separated. Thus, for a rapid feed of the electrode, for example during recharging, it is expedient to drive the spindle, and for the purpose of fine feed during the fusing-off process, to drive the spindle nut.

Particularly in the case of very heavy electrodes and electrodes having a cross-section other than round, for example for the production of slabs, a plurality of spindles can also be provided to achieve a more favorable load distribution. In each case, however, the arrangement is such that portions of the spindle that lie below the spindle nuts are free from bending forces and torque.

BRIEF DESCRIPTION OF THE DRAWING

Examples of the construction of the subject matter of the invention will now be described in greater detail by reference to the appended FIGS. 1 to 6.

FIG. 5 is a front view of the upper portion of an electro-slag remelting furnace but with two guide columns arranged symmetrically in relation to the spindle; and FIG. 6 is a plan view of the FIG. 5 subject matter, but with the parts above the spindle nut omitted.

FIG. 1 shows a furnace frame 1 with a bottom plate 2 and a stationary mold 3 with which is associated a mold bottom 3*a*. Contained in the mold 3 is a partially remelted block 4, which is in the process of building up and above which is located a slag bath 5 into which a consumable electrode 6 extends over a very short distance.

Figure 1:
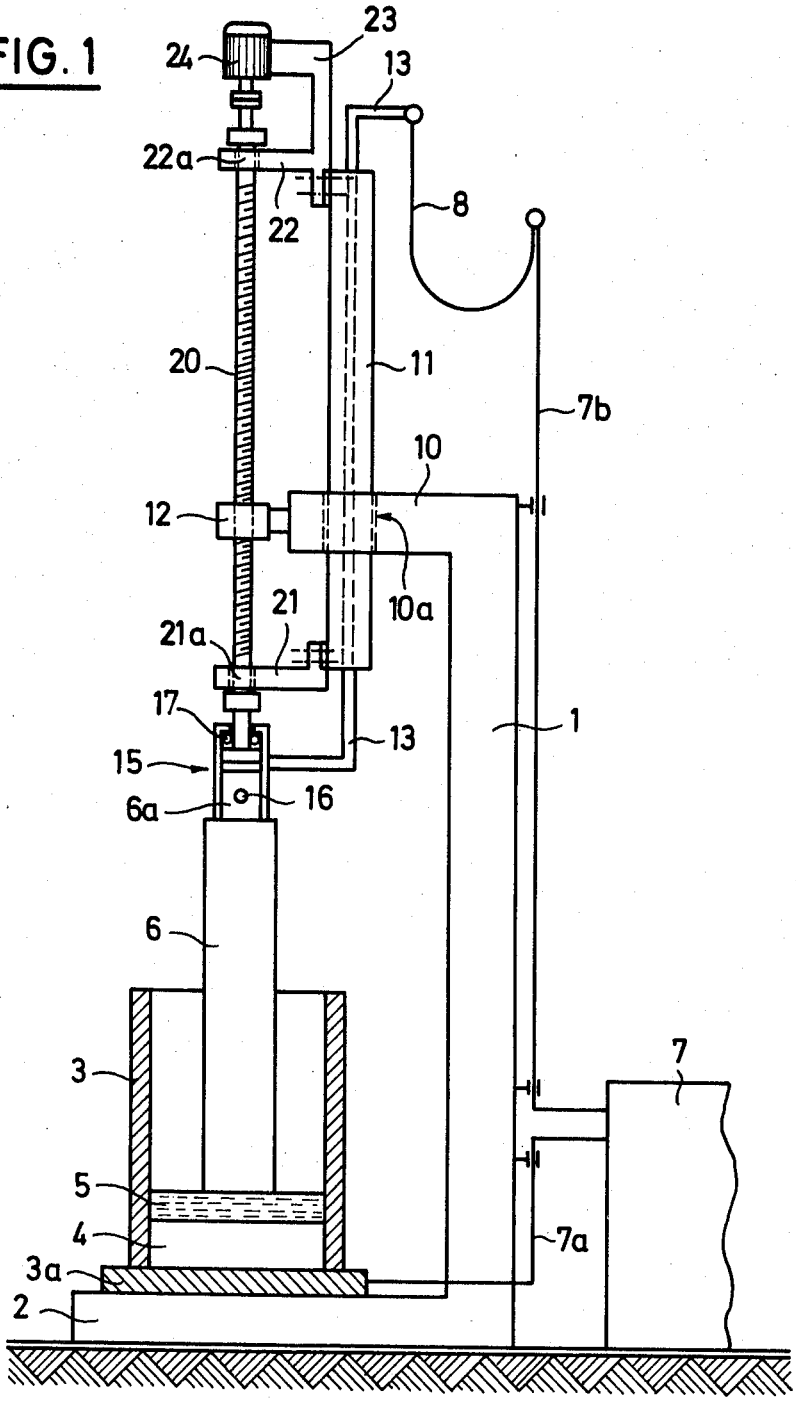
FIG. 1 shows a side view of an electro-slag remelting furnace with only one guide column.

Associated with the electro-slag remelting furnace is a current-supply means 7 which is connected to the furnace by way of bus-bars 7*a* and 7*b*. A flexible current cable 8 is arranged between the bus-bar 7*b* and the on-leading conductor.

Located on the furnace frame 1 is an arm 10 comprising a guide 10*a*, in which a guide column 11 is mounted and vertically displaceable. A spindle nut 12 is also secured to the arm 10. The guide column 11 takes the form of a tube, and in its interior a tubular conductor 13 is guided vertically downwards and is connected to a clamping device 15 for the electrode 6, which for clamping purposes is provided with a stub 6*a*. By means of the current conductor 13 the clamping device 15 is, on the one hand, provided with the required melting current and, on the other hand, is prevented from twisting. Connection between the clamping device 15 and the sub 6*a* is established by means of a bolt 16. Arranged in the upper part of the clamping device 15 is a ball-bearing unit 17, by means of which the clamping device 15 is suspended from the lower end of a spindle 20 (screw-threaded spindle). Bearings 21*a* and 22*a* for the spindle 20 are secured to the guide column 11 by way of arms 21 and 22, these bearings maintaining the spindle parallel with the guide column 11. Provided at the upper end of the guide column 11 is a further arm 23, to which is secured a drive motor 24 for the spindle 20.

Figure 2:
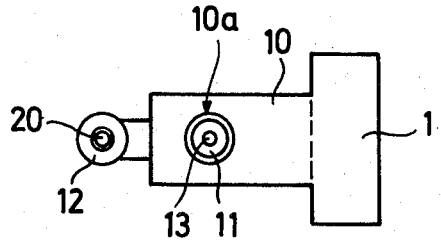
FIG. 2 is a plan view of the furnace shown in FIG. 1 with the parts above the spindle nut being omitted.
Figure 3:
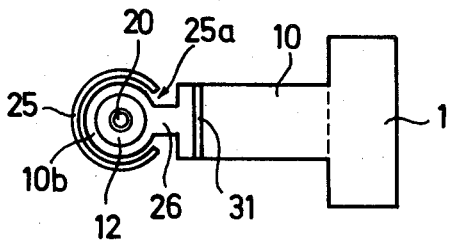
FIGS. 3 and 4 illustrate variants of FIG. 2 subject matter.

The mode of operation of the apparatus shown in FIG. 1 is as follows: If the spindle 20 is turned by means of the drive motor 24, then depending upon the direction of rotation, it moves downwards or upwards relatively to the spindle nut of fixed location, and in so doing entrains the clamping device 15, the current conductor 13 and the guide column 11 by way of the bearings 17, 21*a* and 22*a*. As a result, the height of the entire installation decreases as the fusible electrode 6 is lowered, and it reaches its minimum height when the fusible electrode 6 is practically completely consumed. Parts in FIG. 2 that are similar to those of FIG. 1 are designated by the same reference numerals as in the latter Figure. This also applies as regards FIGS. 3 and 4. FIG. 3 shows a guide column 25, which takes the form of a hollow cylinder which is slotted along one side 25*a* and embraces a guide 10*b*, in which the spindle nut 12 is mounted. The guide column 25 also acts as a current conductor. For this reason the arm 10 is provided, at its end, with an insulator 31, to which is secured a connecting member 26. The guide column 25 is disposed concentrically in relation to the spindle nut 12 and the spindle 20.

Figure 4:
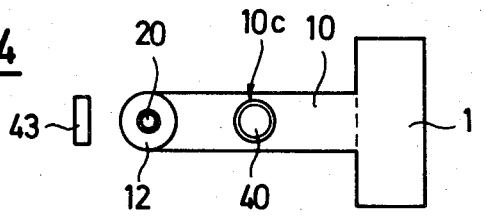

FIG. 4 illustrates a guide column 40, which is mounted in a guide 10*c* in the arm 10. The spindle nut 12 is also of fixed location. However, in contrast to the arrangements depicted in the previous Figures, a current conductor 43, in the form of a separate exterior flat section, is provided, and this is arranged parallel with the guide column 40 and is secured thereto.

FIG. 5 illustrates a variant of the FIG. 1 subject-matter. In this, a drive motor 51 and an arm 52 are arranged on the furnace frame 1, two guides 52*a* and 52*b* being provided in this arm. Two vertically displaceable guide columns 53 and 54 are mounted in these guides. Also, a spindle nut 55, which is of fixed location but is rotatable, is mounted in the arm 52, which nut can be driven by the drive motor 51 by means of the chain 56. Arranged below the guides 52*a* and 52*b* are sliding contacts 58 and 59 of known design, through which the melting current is passed to the guide columns 53 and 54 which consequently also perform the function of current conductors. At their upper ends the guide columns are interconnected by a cross member 60, on which is mounted a further lifting drive 57, which consists of a compressed-medium cylinder 61 having a piston 62 and a piston-rod 63. Suspended from the piston-rod 63 in a manner in which it does not twist is a spindle 65, at the lower end of which is provided a clamping device 15*a*. This comprises two clamping elements 64 and 66 which are movable relatively to each other, the elements 64 being connected to the guide columns 53 and 54, and the element 66 to the spindle 65. The clamping element 66 takes the form of a cylindrical housing and comprises spherical clamping members 67, which are compressed to engage in a complementary recess in the stub 6*a* of the electrode 6. The recess is located below a head 68 which forms the upper end of the stub 6*a*. The spheres can be moved inwards by means of a tapered surface 70, which forms the inner face of the clamping element 64. The clamping element 64 is also part of a cross member 72, which constitutes the lower connection between the guide columns 53 and 54. The clamping element 64 is provided on its lower face with an annular contact surface 73, which lies on the upper end face of the electrode 6. By means of the additional lifting drive 57, limited movement relative to the spindle 65 can be superposed on the guide columns 53 and 54.

In order to release the electrode 6 from the clamping device 15*a*, compressed air is applied to the piston 62 by way of the pressure pipe 74, so that the cylinder 61, the cross member 60, the guide columns 53 and 54, the cross member 72, the contact face 73 and the tapered face 70 move upwardly. The clamping members 67 are thus released and can be pressed out from the head 68, so that the stub 6*a* can be moved from the clamping device 15*a*. For the purpose of inserting an electrode 6*a*, the head 68 is moved towards the clamping element 66 in the reverse manner until it is located above the clamping members 67. The cylinder 61 is moved downwards by the admission of compressed air. The cross member 72 with the tapered surface 70 follows this movement by way of the guide columns 53 and 54, so that the clamping members 67 are forced inwards. The contact surface 73 is applied to the electrode 66. Thereafter, the spindle nut 55 is driven by the motor 51, so that axial displacement of the spindle 65 and a corresponding feed of the entire electrode take place.

FIG. 6 is a plan view of the spindle nut 55 with the chain 56 as well as the drive motor 51, the guide columns 53 and the arm 52 on the furnace frame 1. The current-conducting elements of the entire equipment can be provided with cooling means and screens in the known manner.

We claim:

1. An electro-slag remelting furnace for consumable electrodes and comprising a mold for receiving a melt formed from the electrode material; at least one drive motor and at least one spindle and an associated spindle nut for vertical movement of the electrode; at least one guide column, which is provided for vertically guiding the consumable electrodes and which extends parallel with the spindle and relative to which the spindle is rotatably mounted at its two ends; and at least one clamping device for the consumable electrodes comprising the spindle nut which is of fixed location, the spindle which is mounted in the spindle nut and is vertically displaceable therein, the spindle being connected by its lower end to the clamping device; and a guide in which the guide column is displaceably mounted, together with the spindle.

2. An electro-slag remelting furnace according to claim 1, wherein a drive motor is associated with the spindle.

3. An electro-slag remelting furnace according to claim 1, wherein the spindle nut is rotatably mounted and a drive motor is associated with it.

4. An electro-slag remelting furnace according to claim 1, wherein a separate drive motor is associated with the spindle as well as with the spindle nut.

5. An electro-slag remelting furnace according to claim 1, wherein the guide is arranged in a fixed location on a furnace frame member.

6. An electro-slag remelting furnace according to claim 1, wherein one or more guide columns are also designed as current-supply elements.

7. An electro-slag remelting furnace according to claim 6, wherein a wiper of fixed location is associated with each of the guide columns.

8. An electro-slag remelting furnace according to claim 1, wherein an additional lift drive is arranged between the spindle and the guide columns by means of which lift drive a limited movement relative to the spindle is superposed on the guide columns.

9. An electro-slag remelting furnace according to claim 8, wherein the clamping device has two clamping elements which are movable relatively to each other and one of which is connected to the spindle and the other to the columns.

10. An electro-slag remelting furnace according to claim 1, wherein the lower ends of the guide columns are located above the upper edge of the mold in the bottom position.

* * * * *